US005950535A

United States Patent [19]

Faber

[11] Patent Number: 5,950,535

[45] **Date of Patent: *Sep. 14, 1999**

[54] SELF-INKING STAMP WITH FIXED STAMP PLATE AND ADJUSTABLE STAMP PORTION

[75] Inventor: Ernst Faber, Wels, Austria

[73] Assignee: Colop Stempelerzeugung Skopek GmbH & Co. KG, Wels, Austria

[ * ] Notice: This patent is subject to a terminal disclaimer.

[21] Appl. No.: 08/964,067

[22] Filed: Nov. 4, 1997

Related U.S. Application Data

[62] Division of application No. 08/805,740, Feb. 25, 1997, Pat. No. 5,718,169, which is a continuation of application No. 08/591,156, Jan. 25, 1996, abandoned.

[30] Foreign Application Priority Data

Jan. 27, 1995 [AT] Austria ..... 151/95

[51] Int. Cl.[6] ..... B41J 27/02

[52] U.S. Cl. ..... 101/105; 101/111

[58] Field of Search ..... 101/104, 105, 101/108, 111

[56] References Cited

U.S. PATENT DOCUMENTS

| | | | |
|---|---|---|---|
| 669,137 | 3/1901 | Dobbel | 101/105 |
| 1,401,436 | 12/1921 | Pannier | 101/105 |
| 1,408,389 | 2/1922 | Nordin | 101/111 |
| 3,359,897 | 12/1967 | Harte | 101/334 |
| 3,744,411 | 7/1973 | Becker | 101/111 |
| 3,783,786 | 1/1974 | Ellison et al. | 101/333 |
| 4,090,442 | 5/1978 | Yazawa et al. | 101/111 |
| 4,290,358 | 9/1981 | Hamisch, Jr. | 101/111 |
| 4,337,698 | 7/1982 | Jenkins | 101/105 |
| 4,561,353 | 12/1985 | Chapman et al. | 101/111 |
| 4,823,696 | 4/1989 | Skopek | 101/334 |

FOREIGN PATENT DOCUMENTS

| | | |
|---|---|---|
| 379111 | 4/1985 | Austria . |
| 383 993 | 1/1986 | Austria . |
| 384 999 | 7/1987 | Austria . |
| 598559 | 7/1933 | Germany . |
| 634393 | 8/1936 | Germany . |
| 182745 | 5/1936 | Switzerland . |
| 1 702 | 7/1909 | United Kingdom . |

OTHER PUBLICATIONS

Stationary Trade Review, vol. 65, No. 744, Jan. 1995 (picture of Trodat stamp, Model 4810).

*Primary Examiner*—Edgar Burr
*Assistant Examiner*—Daniel J. Colilla
*Attorney, Agent, or Firm*—Collard & Roe, P.C.

[57] ABSTRACT

There is disclosed a self-inking stamp having a pivotable character unit including fixed stamp characters arranged on a supporting plate and settable stamp characters arranged on at least one loop-shaped character band, the loop-shaped character band being guided over an adjustment wheel, rotatably mounted on a central body of the character unit and associated to the character band, and over a supporting ledge supporting that stamp character of the character band which is intended for printing. The supporting ledge is arranged on the central body to be excentrical in relation to the middle line of the printing field of the stamp, which middle line extends in parallel to the geometric rotation axis of the adjustment wheels, along the one rim of the substantially rectangular printing field that extends in parallel to this middle line, and the supporting plate is arranged on the central body likewise so as to be excentrical in relation to this middle line, along the other rim of the printing field that extends in parallel to this middle line.

7 Claims, 3 Drawing Sheets

SELF-INKING STAMP WITH FIXED STAMP PLATE AND ADJUSTABLE STAMP PORTION

This is a division of my U.S. patent application Ser. No. 08/805,740, filed Feb. 25, 1997, now U.S. Pat. No. 5,718, 169, which is a continuation of my U.S. patent application Ser. No. 08/591,156, filed Jan. 25, 1996, now abandoned.

The invention relates to a self-inking stamp having a pivotable character unit.

Self-inking stamps having a pivotable character unit which merely carries loop-shaped character bands and which has an associated turning mechanism are known, cf. e.g. U.S. Pat. No. 3,783,786 A or AT 384 999 B. Furthermore, such self-inking stamps have already been suggested, cf. e.g. AT 383 993 B, in which a movable character unit comprises fixed stamp characters adjacently arranged on a supporting plate and settable stamp characters arranged on at least one loop-shaped character band; there, too, the character unit is alternately pressable against an ink pad installed in the stamp, and a surface to be stamped, by aid of a turning mechanism to be actuated by pressing down a handle of the stamp; each loop-shaped character band is guided over an adjustment wheel rotatably mounted on a central body of the character unit and associated to the respective character band, and over a support ledge supporting the stamp character of the respective character band intended for printing. The settable stamp characters arranged on the loop-shaped character bands, which characters are in the printing position, are centrally arranged in the print field of the respective stamp in an aperture of the supporting plate carrying the fixed stamp characters. Thereby, however, a relatively large space is required for the supporting plate on which the fixed stamp characters are arranged, because on either side of the supporting ledge a distance enabling passing of these type bands must be provided between the support ledge over which the character bands of the respective stamp are guided and the rim of the aperture that is provided in the said supporting plate for arrangement of the settable stamp characters located on the character bands. Furthermore, an exact adjustment of the level of the printing surfaces of the settable stamp characters to the level of the printing surfaces of the fixed stamp characters is required to achieve a uniform ink-saturated stamp print with this known stamp structure, and for this, as a rule, special adjustment means are provided, by which the position of the settable stamp characters can be adjusted in relation to the position of the fixed stamp characters. Such additional means increase the production costs and also require careful handling which, however, cannot be achieved in many cases. The relatively large dimensions of the supporting plate carrying the fixed stamp characters prevailing with these known stamps also result in relatively large dimensions of the pivotable character unit to which the afore-mentioned supporting plate belongs, and consequently also relatively large dimensions of the entire self-inking stamp, and such dimensions are often undesired for reasons of handling and storage thereof and also increase the production costs.

From GB 1702 A.D. 1909 and CH 182 745 A, furthermore hand stamps are known, wherein variable stamp characters arranged on loop-shaped character bands are combined with fixed stamp characters. The variable and the fixed stamp characters are supported on the stamp lower side via supporting ledges securely attached in a casing portion of the stamp. In detail, on either side of the supporting ledge for the character band, GB 1702 A.D. 1909 shows supporting ledges with fixed printing characters selectively settable into the printing position or into a retracted non-printing position. In contrast thereto, the stamp for the lettering of vouchers illustrated in CH 182 745 A includes a fixed supporting ledge for a fixed text merely on one side of the supporting ledge that supports the character band. However, both known stamps have in common that they are not self-inking but must be pressed onto a separate ink pad before a stamp print is made. On the other hand, when fixedly attaching the supporting ledges in the casing, there are hardly any problems in terms of particular space requirements and of a uniform print as is the case with stamps featuring self-inking means.

It is an object of the invention to provide a self-inking stamp of simple structure and also particularly including a movable character unit of small dimensions, the stamp thus requiring little space.

It is a further object of the invention to provide a self-inking stamp which will yield exact and uniformly inked prints even if it were not used with particular care.

In the self-inking stamp of the invention comprising an ink pad and a pivotable character unit, in the printing position, the supporting ledge for the character band is arranged on the central body of the character unit to be at one side of the middle line of the printing field of the stamp, which middle line extends in parallel to the geometric rotation axis of the adjustment wheels, along the one rim of the substantially rectangular printing field that extends in parallel to this middle line; furthermore, the supporting plate is arranged on the central body likewise so as to be at an opposite side of to this middle line, along the other rim of the printing field that extends in parallel to this middle line. By this design, by the omission of one gap between the settable stamp characters and the supporting plate of the fixed stamp characters and by omitting a part of the unavoidable rim distances between the fixed stamp characters and the rim of the supporting plate, as compared to the known self-inking stamps, smaller dimensions of the character unit can be attained, whereby also correspondingly smaller dimensions of the entire self-inking stamp can be attained. By the adjacent arrangement of the substantially strip-shaped supporting plate for the fixed stamp characters and the supporting ledge for the settable stamp characters known per se from CH 182 745 A, also with the pivotable character unit of the present self-inking stamp, possible slight level differences between the printing surfaces of the settable stamp characters on the one hand and the fixed stamp characters on the other hand do not have any negative effects, because such slight differences in level are compensated by a slanted position of the entire stamp as it automatically results when using the stamp, if they have not already been compensated when pivoting the character unit by the turning mechanism. Thus, no special structural measures are required for adjusting the relative position of the level of the settable stamp characters in relation to the level of the fixed stamp characters, which results in a simpler construction. The two rims of the printing field also may extend at different distances from the middle line that extends below the axis of rotation.

In one embodiment of the self-inking stamp of the invention which allows a stable and compact design of the character unit with a simple structure, the supporting ledge is integral with the central body of the character unit that carries the adjustment wheel or wheels.

In terms of as simple an assembly of the character unit as possible, an embodiment is advantageous, in which the supporting plate is connected with the central body of the character unit via a latch connection.

A particularly advantageous embodiment of the self-inking stamp of the invention, which, when using the stamp, ensures exact positioning of the settable stamp characters intended for printing even if a more pronounced thrust is exerted on the rim side of the settable stamp characters that faces away from the fixed stamp characters, is characterised in that on its inner surface, the at least one character band is provided with transverse ribs arranged at regular intervals from each other, and the supporting ledge comprises at least one engagement groove at the supported side of the character band for engagement with these transverse ribs.

In terms of easy mounting of the character unit it is also advantageous if the central body includes an open bearing shell into which the adjustment wheel is inserted. In conjunction with the afore-mentioned design of the character band (or character bands, respectively) including transverse ribs, this results in a particularly advantageous embodiment which facilitates positioning of the respective settable stamp characters intended for printing, if the bearing face of the bearing shell is a regular polygonal prism face and the adjustment wheel carries successive transverse ribs externally on its supported surface at angular distances corresponding to this prism face and at the mutual intervals of the transverse ribs of the character band.

A different, structurally very simple embodiment is characterised in that the adjustment wheel is provided with a bearing recess and mounted on a bearing axle which is integral with the central body or joined thereto.

The invention will now be explained in more detail with reference to examples schematically illustrated in the drawing.

Figure 1:
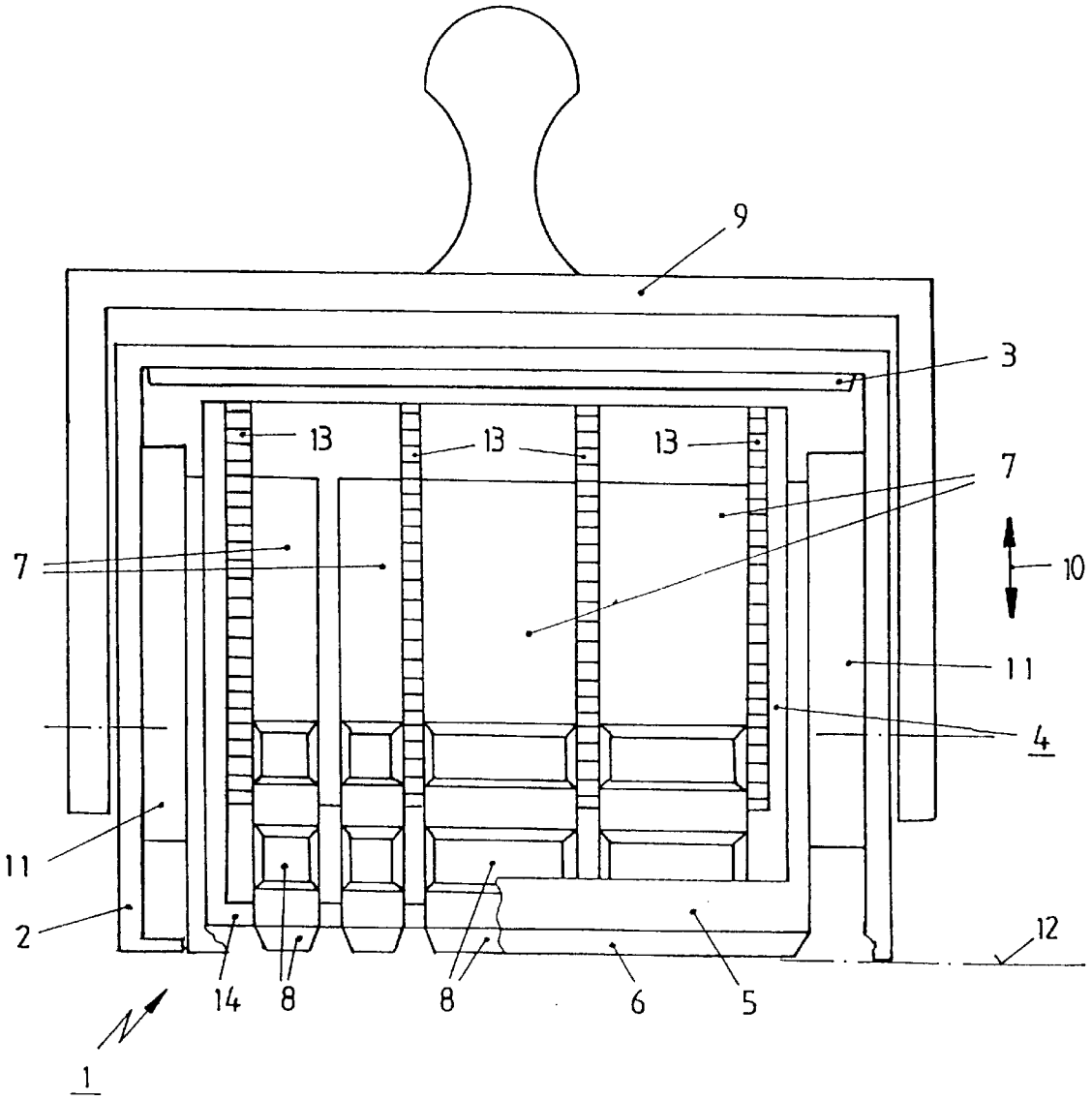
FIG. 1 shows an embodiment of the currently preferred self-inking stamp according to the invention in a rough schematical, partly broken-up elevation.

The self-inking stamp 1 illustrated in FIG. 1 comprises, similar to the stamp e.g. according to AT 383 993 B, a casing 2, at whose upper side an ink pad 3 is arranged to face downwards. In the casing 2, a character unit 4 is pivotably mounted and carries fixed stamp characters 6 arranged on a supporting plate 5, and settable stamp characters 8 arranged on loop-shaped character bands 7 adjacently to said fixed stamp characters 6. By means of a turning mechanism 11, upward and downward movements of an actuating handle 9 in the direction of the double arrow 10 alternately press the character unit 4 against the ink pad 3 and against a surface 12 to be stamped, the stamp characters 6, 8 taking up ink from the ink pad 3 and then making a corresponding imprint on the surface 12. The loop-shaped character bands 7 are each guided over an adjustment wheel 13 associated to a respective character band 7 and over a supporting ledge 14 supporting the respective stamp character 8 of the respective character band 7 intended for printing.

Figure 2:
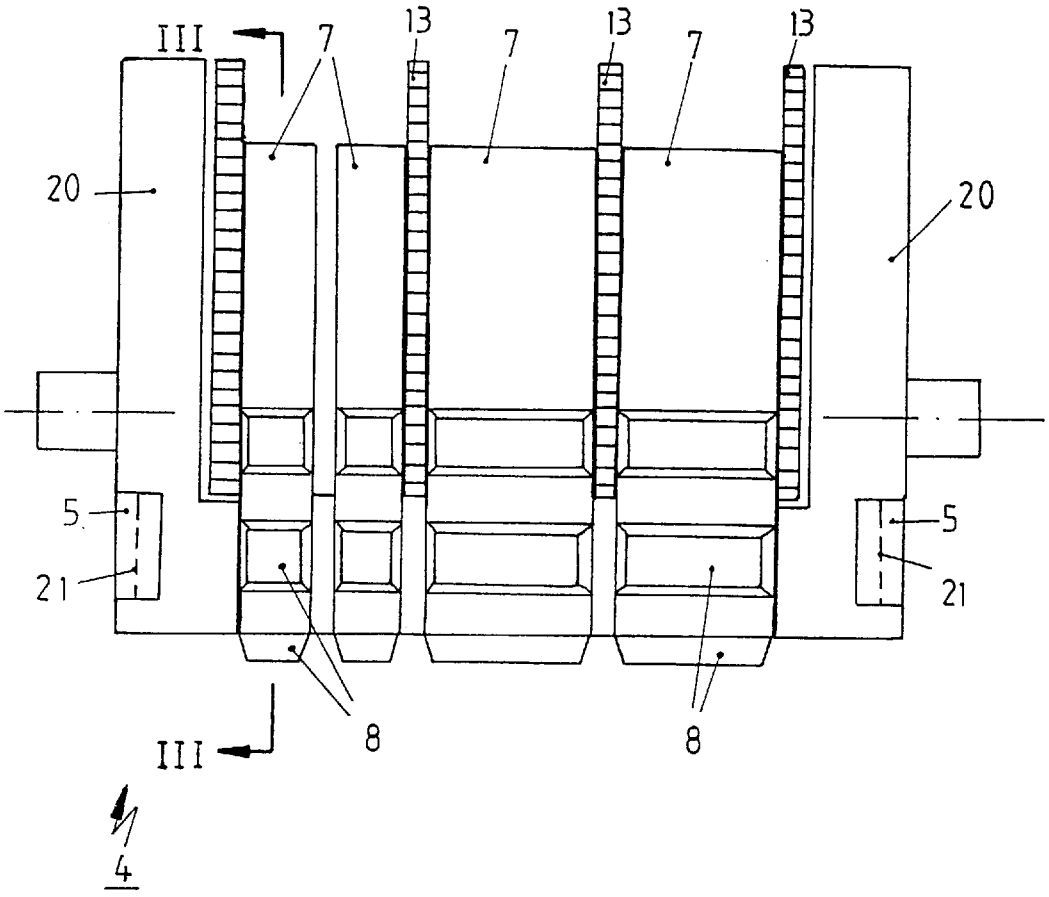
FIG. 2 shows a character unit of such a self-inking stamp in front view.
Figure 3:
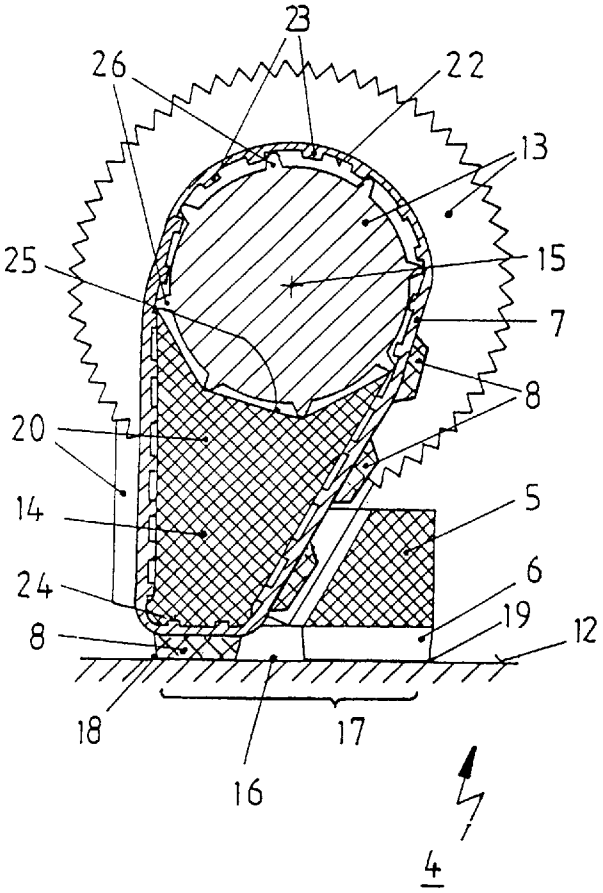
FIG. 3 shows this character unit in a sectional view according to line III—III of FIG. 2.
Figure 4:
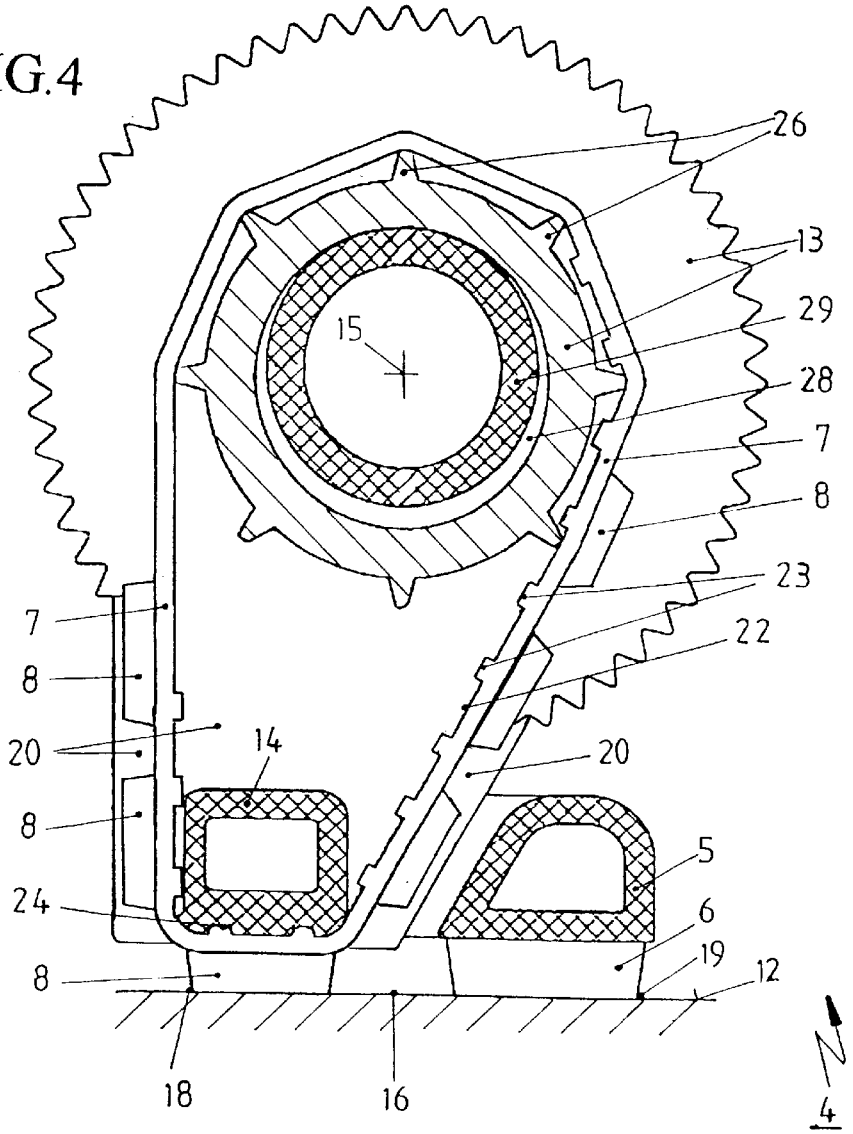
FIG. 4 shows a different embodiment of such a character unit in a section led analogous to FIG. 3.

As is apparent from FIGS. 3 and 4, in the present s tamp 1 the supporting ledge 14 is arranged to be at one side of the middle line 16 of the printing area 17 of the stamp 1, which middle line extends in parallel to the geometric rotation axis 15 of the adjustment wheels 13 and perpendicularly to the drawing plane, along the one rim 18 of the substantially rectangular printing area 17, which rim extends in parallel to this middle line 16. The supporting plate 5 likewise is arranged to be at the other side of this middle line 16 along the other rim 19 of the substantially rectangular printing area 17, which other rim also extends in parallel to the middle line 16. The rims 18, 19 may extend at different distances from the middle line 16. The supporting ledge 14 and the supporting plate 5 are arranged on the central body 20 of the character unit 4, the supporting ledge 14 being integral with the central body 20 (i.e. formed in one piece with the same), and the supporting plate 5 is joined to the central body 20 by means of a conventional latch connection 21 merely schematically illustrated in FIG. 2.

In the embodiments illustrated in FIGS. 3 and 4, the inner surfaces 22 of the character bands 7 are provided with transverse ribs 23 arranged at regular intervals from each other, and the supporting ledge 14 includes engagement grooves 24 for engagement of these transverse ribs 23.

In the embodiment illustrated in FIGS. 2 and 3, the central body 20 includes an open bearing shell 25, into which the shaft portions of the adjustment wheels 13 are laid, cf. FIG. 3. The bearing face of the bearing shell 25 is a regular polygonal prism face, and the adjustment wheels 13 carry transverse ribs 26 externally on their shaft portions successively arranged at regular angular distances, the angular distances of the transverse ribs 26 corresponding to the mutual intervals of the transverse ribs 23 provided on the inner face of the character bands 7.

Figure 5:
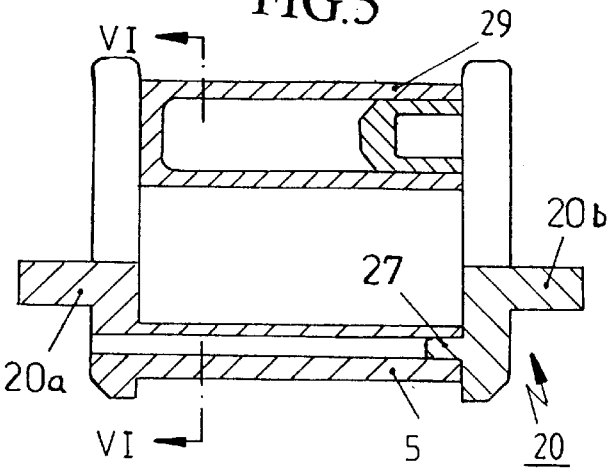
FIG. 5 shows the central body of a further embodiment of such a character unit in longitudinal section.

The central body 20 may be designed in one piece, as is shown by FIG. 3, yet for facilitating the assembly of the character unit, it may also consist of two assembled parts joined by a pin connection 27, e.g., cf. FIG. 5.

In the embodiment illustrated in FIG. 4, the adjustment wheels 13 are provided with a bearing recess 28 and mounted on a bearing axle 29 integral with the central body 20 or joined thereto (cf. FIG. 5).

Figure 6:
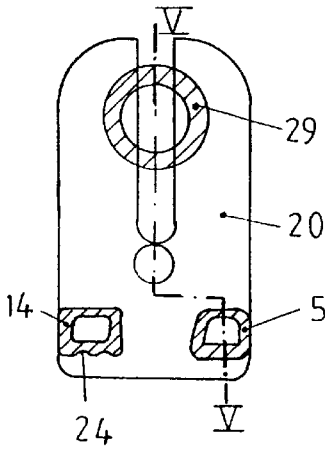
FIG. 6 shows this central body in a section along ine VI—VI of FIG. 5.

The embodiment of a central body 20 for a character unit of a self-inking stamp illustrated in FIGS. 5 and 6 also comprises a bearing axle 29 for mounting the adjustment wheels guiding the character bands of the stamp. Also in this case, the central body is comprised of assembled parts 20*a*, 20*b*, the supporting ledge 14 and the supporting plate 5 in this case being directly formed to the parts forming the central body 20.

What is claimed is:

1. A self-inking hand stamp comprising (a) a casing configured to be placed on a surface to be printed, (b) a character unit pivotably mounted in the casing and including (1) a central body, (2) at least one adjustment wheel rotatably mounted on the central body and having a rotation axis, (3) a supporting plate carrying first stamp characters fixedly arranged thereon, said supporting plate being fixedly arranged on the central body by a latch connection, (4) at least one loop-shaped character band accommodating second, settable stamp characters adjacent the first stamp characters, the at least one loop-shaped band being guided over the at least one rotatable adjustment wheel associated therewith, and (5) a supporting ledge supporting a respective one of the second stamp characters to be printed, the supporting ledge guiding the at least one loop-shaped character band, said supporting ledge being integrally formed with the central body, (c) an ink pad installed in the casing, (d) a handle for the hand stamp mounted on the casing and capable of being pressed down, (e) a turning mechanism for turning the character unit and actuatable by pressing down the handle, the character unit being alternately pressable against the ink pad and against the surface to be printed by said turning mechanism and said handle, and (f) a substantially rectangular plane printing area provided on the casing and including a line of projection which extends in the plane of the printing area parallel to said rotation axis, said rectangular printing area having a first and a second rim, both rims extending parallel to said line of projection at respective sides thereof, (g) the supporting ledge being arranged on the central body at one side of the line of projection along the first rim of the printing area, and (h) the supporting plate being arranged on the central body at the other side of the line of projection along the second rim of the printing area.

2. A self-inking hand stamp as set forth in claim 1, wherein said at least one character band has transverse ribs provided at its inner surface at regular intervals from each other, and wherein said supporting ledge has at least one engagement groove provided where said at least one character band rests on said supporting ledge, for engagement with said transverse ribs.

3. A self-inking hand stamp as set forth in claim 1, further comprising an open bearing shell provided in said central body, said at least one adjustment wheel being supported by said bearing shell.

4. A self-inking hand stamp as set forth in claim 1, further comprising an open bearing shell provided in said central body, said at least one adjustment wheel being supported by said bearing shell, wherein said bearing shell has a bearing face designed as a regular polygonal prism face, and wherein said at least one adjustment wheel carries successive second transverse ribs externally on its supported surface at angular distances corresponding to this prism face and at the mutual intervals of the first transverse ribs of the character band.

5. A self-inking hand stamp as set forth in claim 1, wherein said central body further comprises a bearing axle and said at least one adjustment wheel has a bearing recess and is mounted on said bearing axle.

6. A self-inking hand stamp as set forth in claim 1, wherein said central body further comprises a bearing axle and said at least one adjustment wheel has a bearing recess and is mounted on said bearing axle and wherein said bearing axle is integrally shaped with said central body.

7. The self-inking hand stamp as set forth in claim 1, wherein the supporting ledge and the supporting plate are spaced from the line of projection at different distances.

* * * * *